US007676172B2

(12) United States Patent
Budding et al.

(10) Patent No.: US 7,676,172 B2
(45) Date of Patent: Mar. 9, 2010

(54) CLEANING HEAD PICK-UP SYSTEM

(75) Inventors: Benjamin Budding, London (GB); Mark Gearing, Bigglesward (GB); Stephen P. Wood, Dunstable (GB); Christopher D. Olliffe, Berkhamsted (GB); Christopher Sneath, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 403 days.

(21) Appl. No.: 11/820,826

(22) Filed: Jun. 21, 2007

(65) Prior Publication Data

US 2008/0317494 A1 Dec. 25, 2008

(51) Int. Cl.
*G03G 15/02* (2006.01)

(52) U.S. Cl. ..... 399/101; 399/100; 399/311

(58) Field of Classification Search ..... 399/99, 399/100, 101, 121, 311
See application file for complete search history.

(56) References Cited

U.S. PATENT DOCUMENTS 4,788,573 A * 11/1988 Nakaoka et al. ..... 399/100
5,023,748 A * 6/1991 Okamoto et al. ..... 399/100
5,485,251 A * 1/1996 Kita et al. ..... 399/343
5,809,375 A 9/1998 Owens, Jr. et al.
5,911,531 A 6/1999 Fiore
6,033,452 A 3/2000 Fina et al.
6,963,705 B2 11/2005 Quinones
2006/0280531 A1 12/2006 Washington et al.

* cited by examiner

*Primary Examiner*—David P Porta
*Assistant Examiner*—Benjamin Schmitt

(57) ABSTRACT

A corotron cleaning assembly includes a self-seating, spring-loaded locating pin drivingly connected to a drive unit that is used to drive a wire cleaning head that is located within a CRU. This assembly allows for easy separation of the drive unit from the cleaner when the CRU that contains the wire is replaced. The bullet shaped pin rides on a worm drive and when the pin is driven into the cleaner head, the bullet hits an inclined ramp and is biased downward until such a point that the pin hits a recessed receptacle. Once the pin is in the receptacle, the pin is capable of driving the wire cleaning head. When the cleaning head is removed, the act of removal separates the pin from the receptacle.

21 Claims, 8 Drawing Sheets

CLEANING HEAD PICK-UP SYSTEM

This invention relates generally to an electrostatographic printing machine, and more specifically, to a customer replacement unit (CRU) for such a machine that includes a corotron cleaning head that is driven back and forth the length of corotron wires.

Typically, in an electrophotographic printing process of printers, such as, U.S. Pat. No. 6,033,452, which is incorporated herein by reference to the extent necessary to practice the present disclosure, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface, which is usually a photoreceptor. The toner powder image is then transferred from the photoconductive member to a copy substrate.

This transfer is typically carried out by the creation of a "transfer-detack zone" (often abbreviated to just "transfer zone") of AC and DC biases where the print sheet is in contact with, or otherwise proximate to, the photoreceptor. A DC bias applied to the back (i.e., on the face away from the photoreceptor) of the paper or other substrate in the transfer zone electrostatically transfers the toner from the photoreceptor to the paper or other substrate presented to the transfer zone. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

In printing machines such as the one described above, a CRU is a customer replacement unit which can be replaced by a customer at the end of life or at the premature failure of one or more of the xerographic components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copier/printers. CRUs insure maximum up time of copier/printers and minimize down time and service cost due to end of life or premature failures.

It is important that customer replacement units be customer friendly. That is, it is important that the CRUs may be easily removed and reinstalled with minimal instructions and minimal training. Unfortunately, the CRUs typically include a number of items that are critical to the proper operation of the machine, e.g., charging devices, photoreceptors and developer subsystems and developer subsystems. The components and subsystems are very delicate and need to be properly handled and not damaged during the installation and removal of the CRUs.

Electrostatographic printing and copying machines are susceptible of airborne contamination within the printing machine. For example, airborne contaminants in the form of toner cleaned from the photoreceptor may damage intricate electronic components, e.g., the charge corotron or other corotrons within the printing machine, interfere with the quality of the copy sheets in the exposure and development station and generally cause copy quality and reliability problems within the printing machine. One method of alleviating this problem is to allow non-contaminated air to flow over the charge device in order to remove any contaminants which would affect the performance of the unit, i.e., (nitrous oxide a cause of parking deletions).

U.S. Pat. Nos. 5,809,375; 5,911,531; 6,033,452; 6,963,705 B2 and Patent Application Publication 2006/0280531 A1 appear to be relevant to this disclosure. In U.S. Pat. No. 5,809,375, a modular xerographic customer replaceable unit is shown that includes retaining features and cooperates with a drive module with certain retractable features that allow the insertion and removal of the CRU without causing damage to the photoreceptor and other critical subsystems. An interface with a single handle assembly retracts/unlocks and extends/ locks the module and the associated CRU subsystems into an operative position. U.S. Pat. No. 6,033,452 is directed to a filter for use in a CRU of a printing machine for trapping contaminants from a stream of air passing through the filter. U.S. Pat. No. 5,911,531 discloses a printer apparatus that includes a blower that uses non-contaminated air to force contaminated air away from CRU parts, such as, the corotrons in order to improve copy quality and part life. In U.S. Pat. No. 6,963,705 B2 an xerographic printing apparatus employs corotron wires to apply a charge to a photoreceptor. The wires are cleaned by a motorized shuttle which travels in two directions along the wires. The shuttle is controlled by detection of an increased current consumption associated with the motor. U.S. Patent Application Publication 2006/0280531 A1 discloses a xerographic apparatus that uses a partially conductive shield disposed between a non-imaging portion of an imaging member and a portion of a corotron member to prevent the accumulation of stray toner particles. However, corotrons are still being degraded by contaminants.

Obviously, there is still a problem with stray toner particles spreading through a xerographic printing module or machine, causing undesired marking on a print sheet passing through the transfer zone. Thus, the need for a low cost system that promotes ease in cleaning contaminants from corotron wires in order to improve copy quality and prolong their useful life.

In answer to this need, provided hereinafter is a corotron cleaning assembly that includes a self-seating, spring-loaded locating pin drivingly connected to a drive unit that is used to drive a wire cleaning head that is located within a CRU. This assembly allows for easy separation of the drive unit from the cleaner when the CRU that contains the wire is replaced. Essentially, a bullet shaped pin rides on a worm drive and when the pin is driven into the cleaner head, the bullet hits an inclined ramp and is biased downward until such a point that the pin hits a recessed receptacle. Once the pin is in the receptacle, the pin is capable of driving the wire cleaning head. When the cleaning head is removed, the act of removal separates the pin from the receptacle. An advantage of this design is placing most of the mechanism in the fixed machine rather than in the CRU, hence reducing CRU cost.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
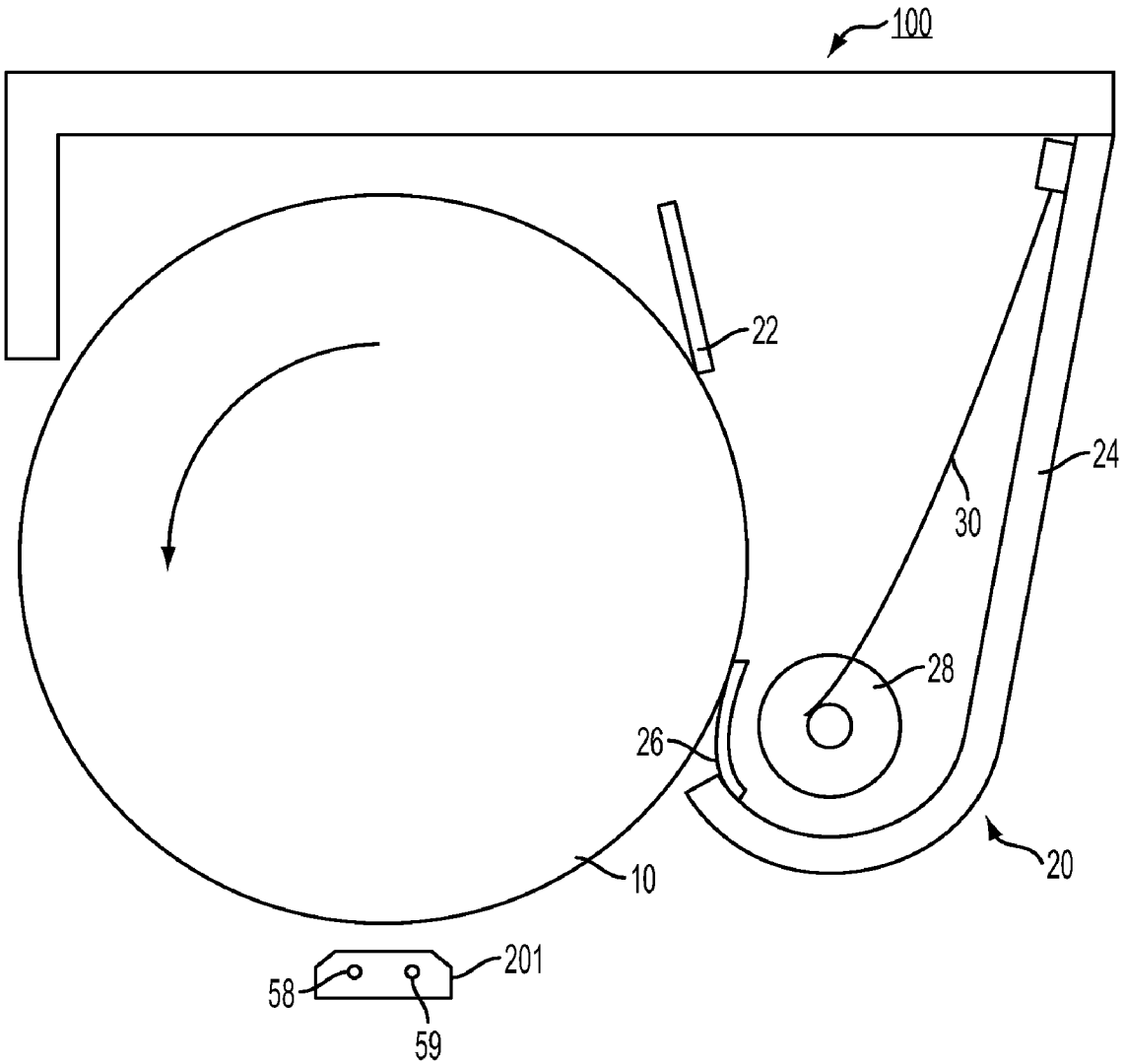
FIG. 1 is a simplified elevational view of a portion of a printing machine.

The disclosure will now be described by reference to a xerographic printing apparatus that includes an improved corotron cleaning apparatus.

For a general understanding of the features of the disclosure, reference is made to the drawings. In the drawings, like reference numerals have been used throughout to identify identical elements.

Figure 2:
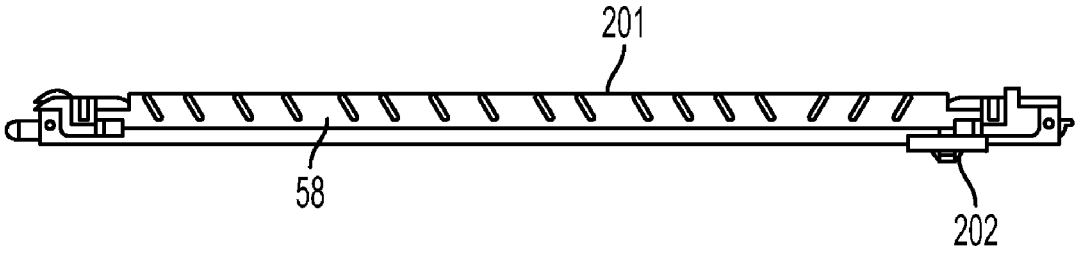
FIG. 2 is a side view of a customer replaceable corotron unit for use in the printing machine of FIG. 1.
Figure 3:
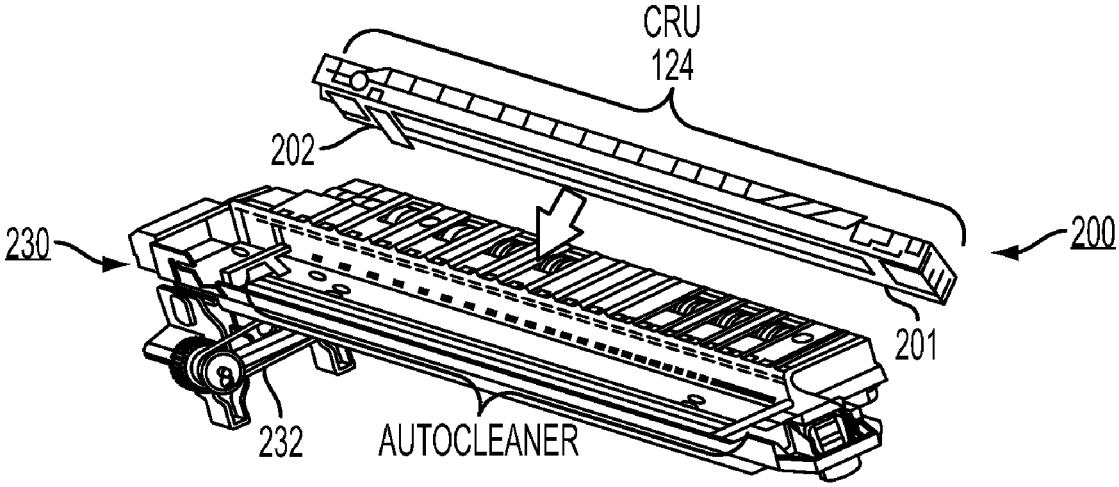
FIG. 3 is a partially exploded perspective view showing a corotron/detack unit being placed onto a short paper path structure.

FIG. 1 is a simplified elevational view, and FIG. 2 is a partial side view of the corotron and cleaning head pick-up assembly of the present disclosure, both showing relevant elements of an electrostatographic or xerographic printing apparatus, many of which are disposed within a module housing generally shown as 100, and which may in turn be installed in a larger printing machine. As is well known, an electrostatic latent image is created, by means not shown, on a surface of an imaging member, such as, a photoreceptor 10. The latent image is developed by applying thereto a supply of toner particles, such as, with a developer roll (not shown), which may be of any of various designs, such as, a magnetic brush roll or donor roll, as is familiar in the art. The toner particles adhere to the appropriately-charged areas of the latent image. The surface of photoreceptor 10 moves, as shown by the arrow, to a transfer zone created by a transfer-detack customer replaceable unit 201 of (CRU) 124 shown in FIGS. 2 and 3. Simultaneously, a print sheet on which a desired image is to be printed is conveyed to the transfer zone as well.

At the transfer zone, the print sheet is brought into contact or at least in proximity with a surface of photoreceptor 10, which at this point is carrying toner particles thereon. A corotron or other charge source in CRU 124 causes the toner on photoreceptor 10 to be electrically transferred to the print sheet. The print sheet is then sent to subsequent stations, as is familiar in the art, such as, a fuser and finishing devices (not shown).

Following transfer of most of the toner particles to the print sheet in the transfer zone, any residual toner particles remaining on the surface of photoreceptor 10 are removed at a cleaning station, which is generally indicated as 20. A cleaning blade 22 is urged against the surface of photoreceptor 10 and scrapes the residual toner off the surface. The toner which is thus removed falls downward into a hopper 24 formed in housing 100 for accumulating the toner. A flexible seal 26, extending the length of the photoreceptor 10, prevents loose toner from escaping the hopper.

At the bottom of the hopper is an auger 28, shown end-on in the view of FIG. 1. The auger extends substantially the length of the photoreceptor 10. The auger 28 is rotated and thus conveys toner particles at the bottom of the hopper to some sort of waste container (not shown). An agitator 30, made of a thin, flexible material, can interact with the auger to clean the flights of the auger.

Turning now to FIGS. 3-6, an improved automatic corotron cleaning apparatus 200 is disclosed showing transfer/detack unit 201 that includes corotrons 58 and 59 of CRU 124 in the process of being loaded onto short paper path assembly 230 which is attached to the printer in FIG. 1. Short paper path assembly 230 includes a conventional drive mechanism having a small DC motor (not shown) that is connected to belt 232 of FIG. 6 which is entrained around pulley 234 and driven through gear 236 positioned on the same shaft as pulley 234.

Paper ribs 238 are positioned on a housing surface of short paper path assembly 230 and used to guide a sheet onto drive rolls 239 for transport to a downstream fuser (not shown). Air duct 249 is part of a manifold that links to a dirt manifold on one side of the housing.

Figure 4A:
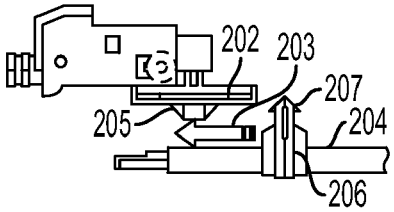
FIGS. 4A-4C are partial elevation views showing various positions of an engagement latch mechanism.
Figure 4B:
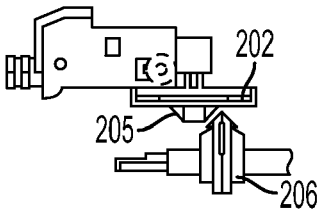
Figure 4C:
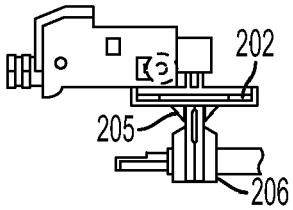
Figure 5:
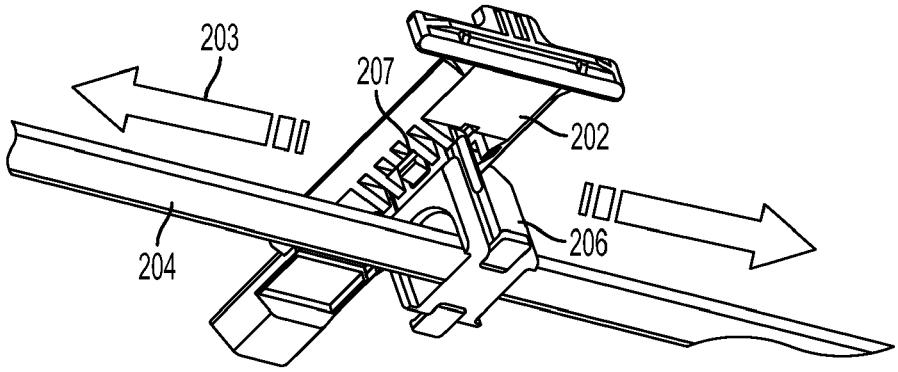
FIG. 5 is a partial perspective view showing a cleaning head being moveable in opposite directions along a shaft by the latch engagement mechanism of FIG. 4.
Figure 6:
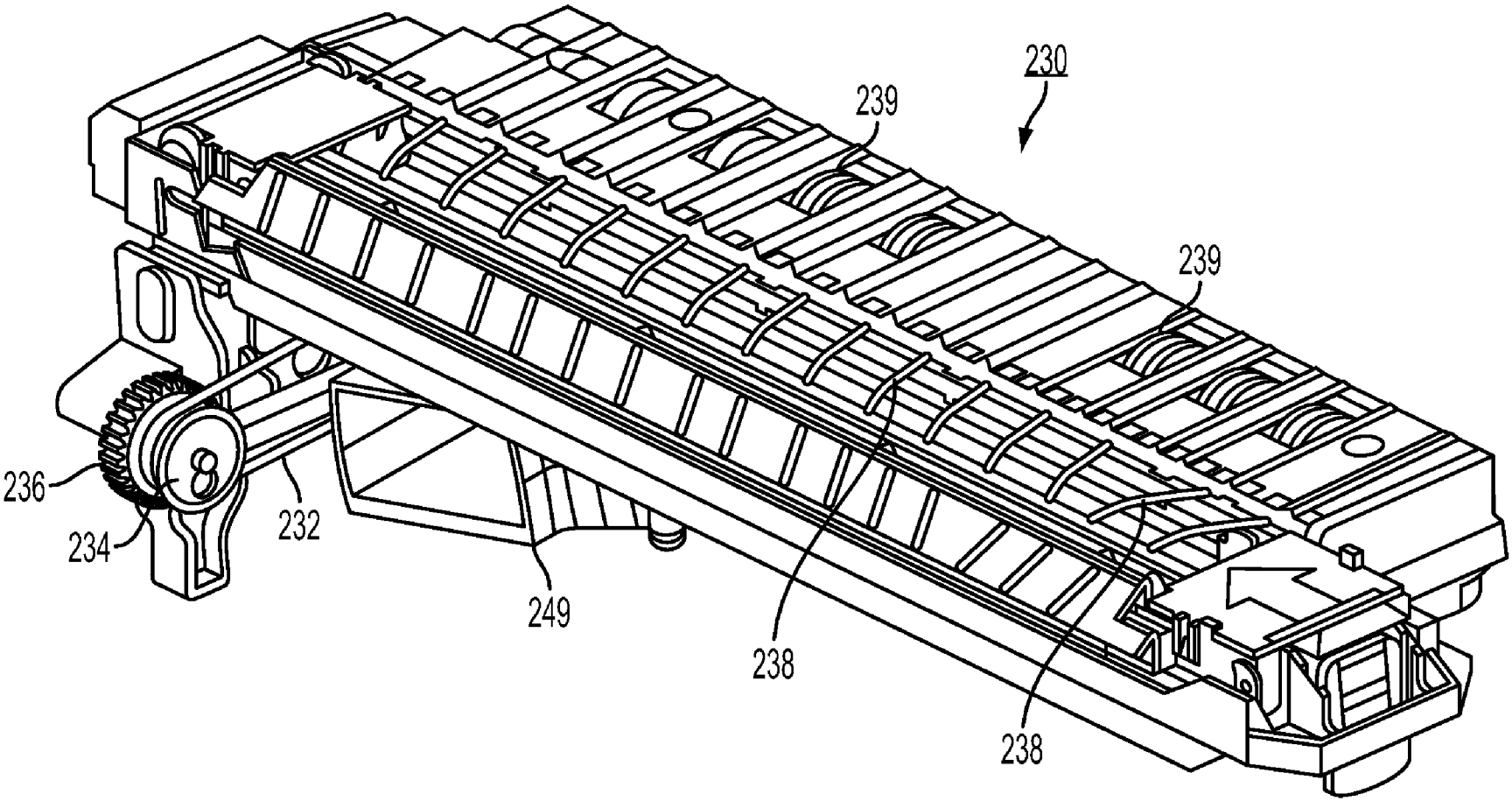
FIG. 6 is a partial perspective showing the short paper path of the printer.

A wire cleaning head 202 is positioned and slidably attached to the housing of detack/transfer corotrons 58 and 59. Wire cleaning head 202 includes a plastic carrier fitted with a suitable cleaning material that is moved up and down the length of the corotrons by a drive mechanism positioned within the short paper path assembly. In FIGS. 4A-4C, cleaning head 202 is shown being moved progressively in the direction of arrow 203 along two-start threaded shaft 204 by springable engagement latch 206 that has a locating pin 207 projecting from an end thereof. Locating pin 207 includes bullet shaped projections therefrom. In FIG. 4A, engagement latch 206 is positioned along shaft 204 removed from cleaning head 202 and in FIG. 4B, the engagement latch has been moved into approximate contact with the right end of downwardly extending entry ramps 205 of cleaning head 202. In FIG. 4C, engagement latch 206 has been deflected down inclined entry ramp 205 and sprung up into a recessed receptacle in a center portion of cleaning head 202 as shown in FIG. 5.

This split design locates the complexity and attendant cost of a drive mechanism into the host system short paper path and leaves the minimal cost of the cleaning element in the CRU. In addition, the design is capable of locating and engaging the two mating parts without the need for complex user operation since it has the ability to accommodate all of the positional disparities between the short paper path and the corotrons, including the variabilities associated with customer involvement in changing the unit. Once engaged, the drive will move the cleaning head the length of the corotrons in a controlled fashion achieving a cleaning function as it moves.

Figure 7:
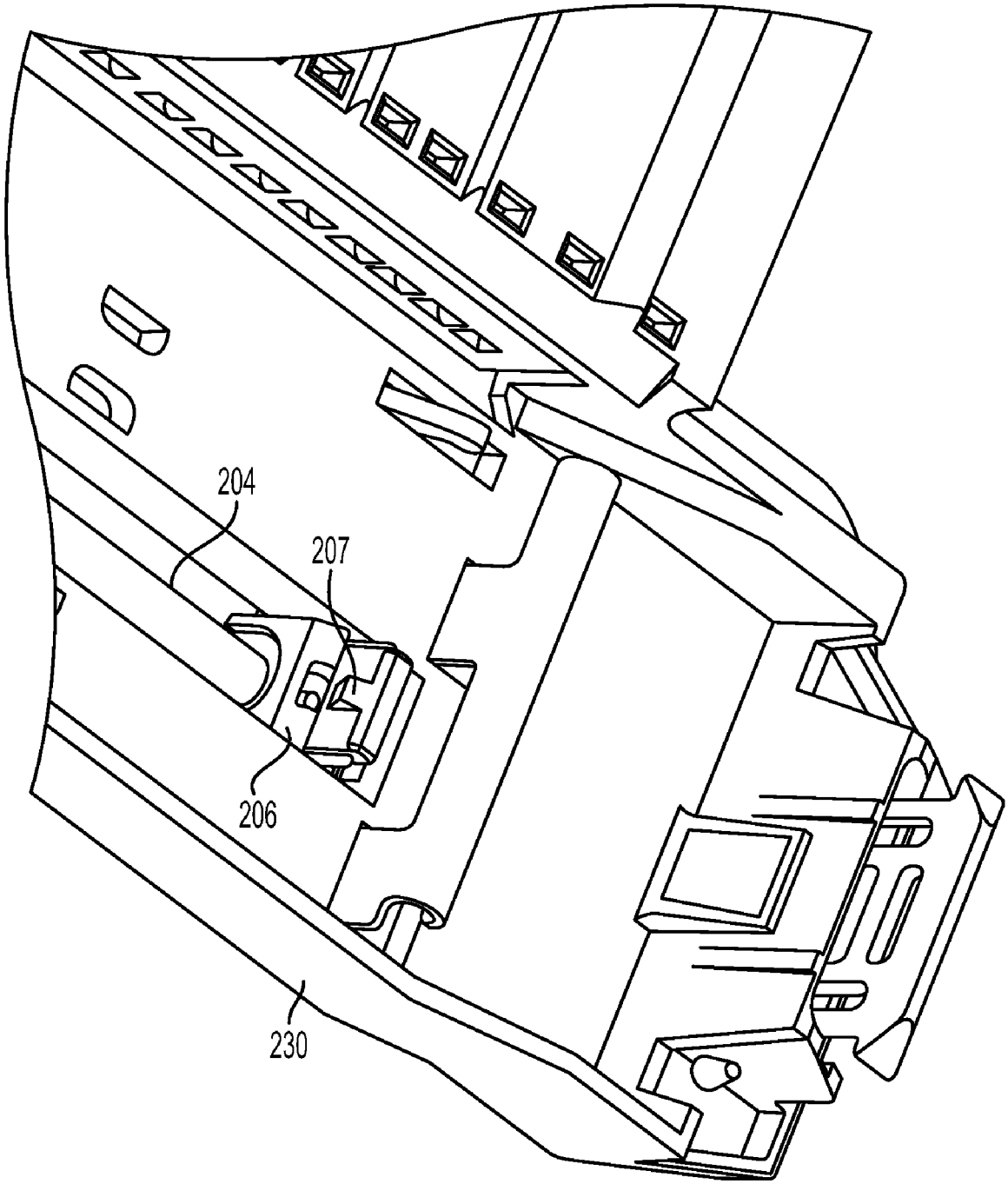
FIG. 7 is partial perspective view showing a self-seating, spring loaded engagement latch that is used to drive the wire cleaning head of FIGS. 4A-4C.
Figure 8:
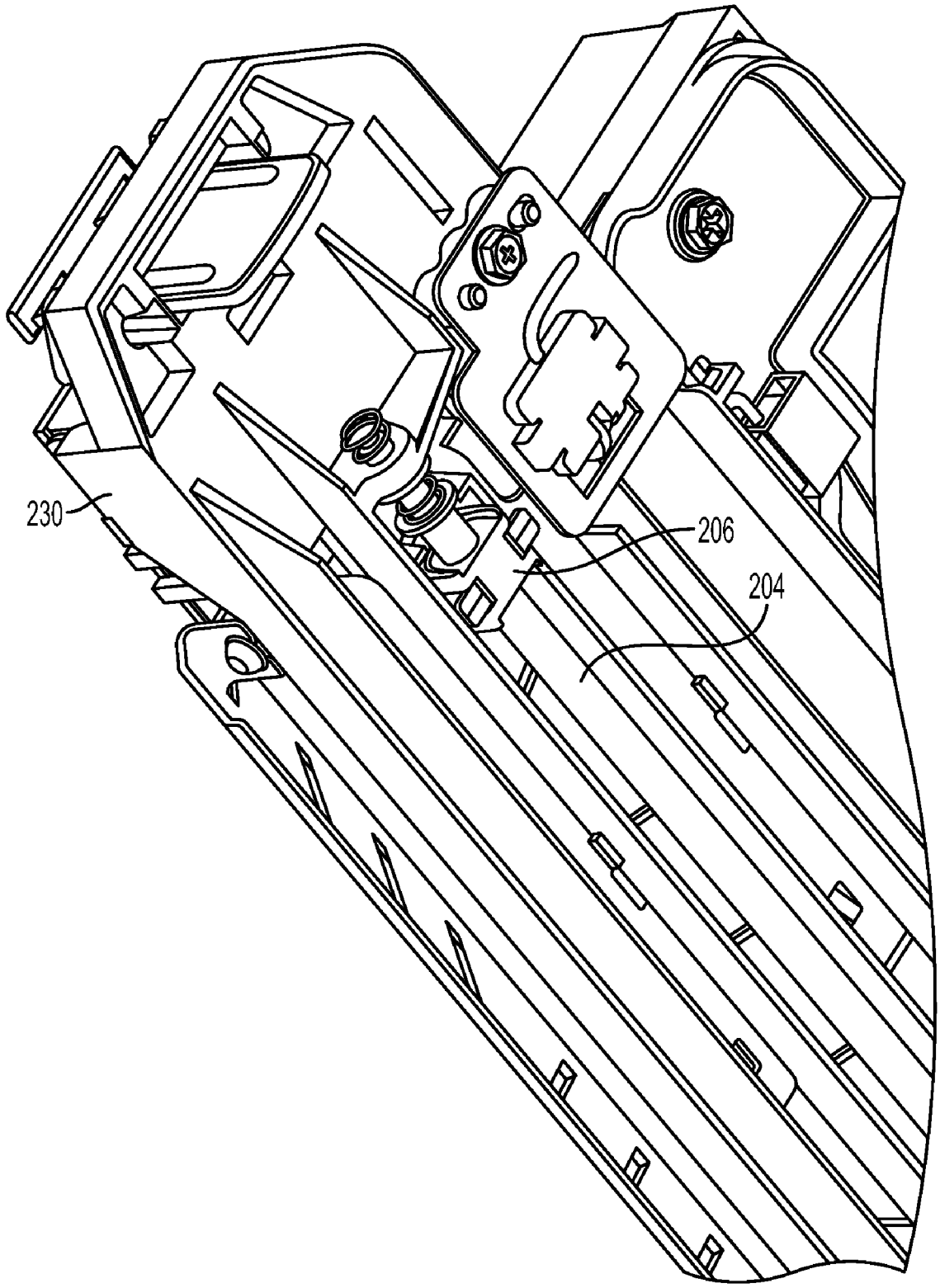
FIG. 8 is a partial perspective bottom view of FIG. 7 showing spring loading of the engagement latch.
Figure 9:
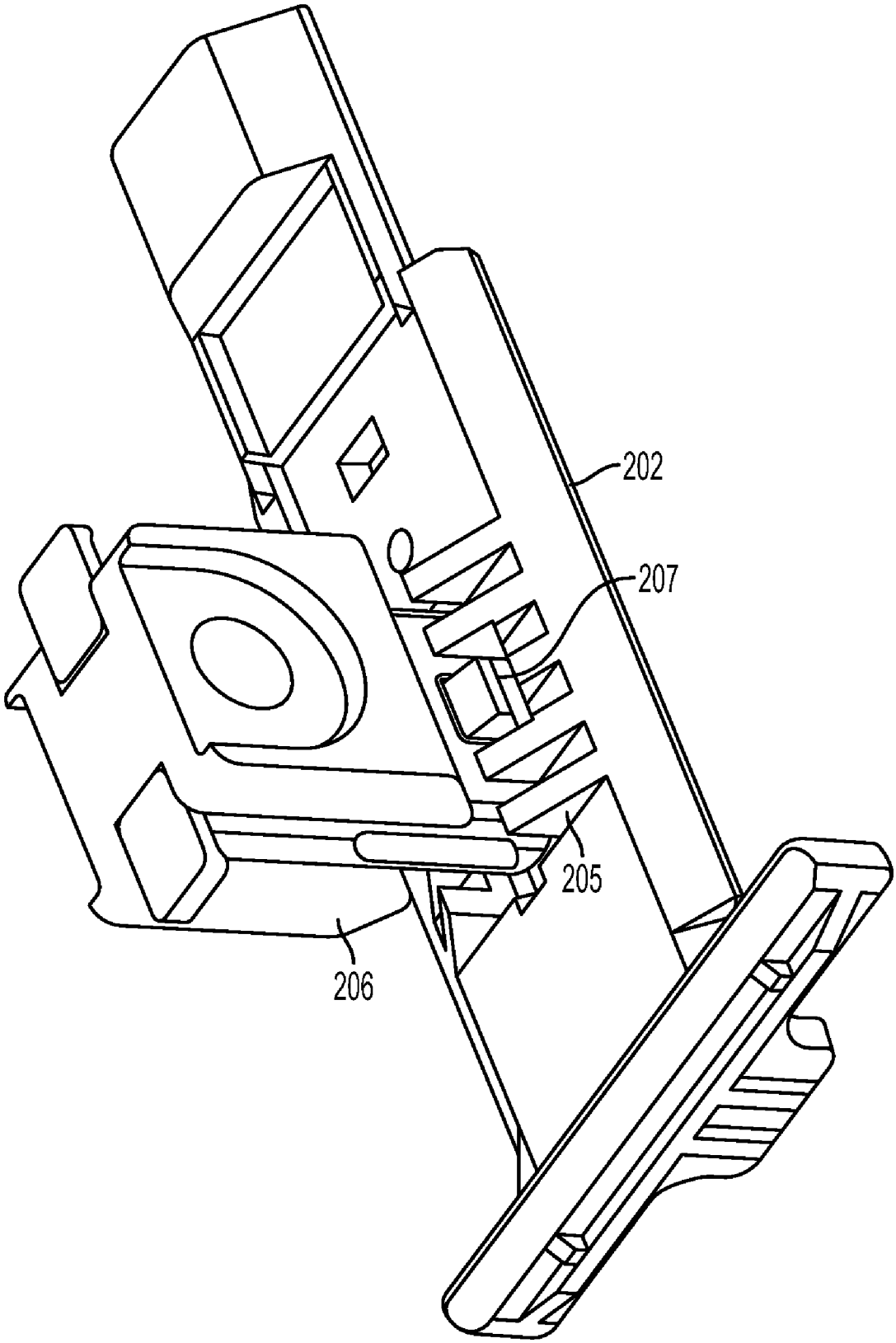
FIG. 9 is a partial perspective bottom view of the of the spring loaded locating pin securely seated within a receptacle of the cleaning head of FIGS. 4A-4C.
Figure 10:
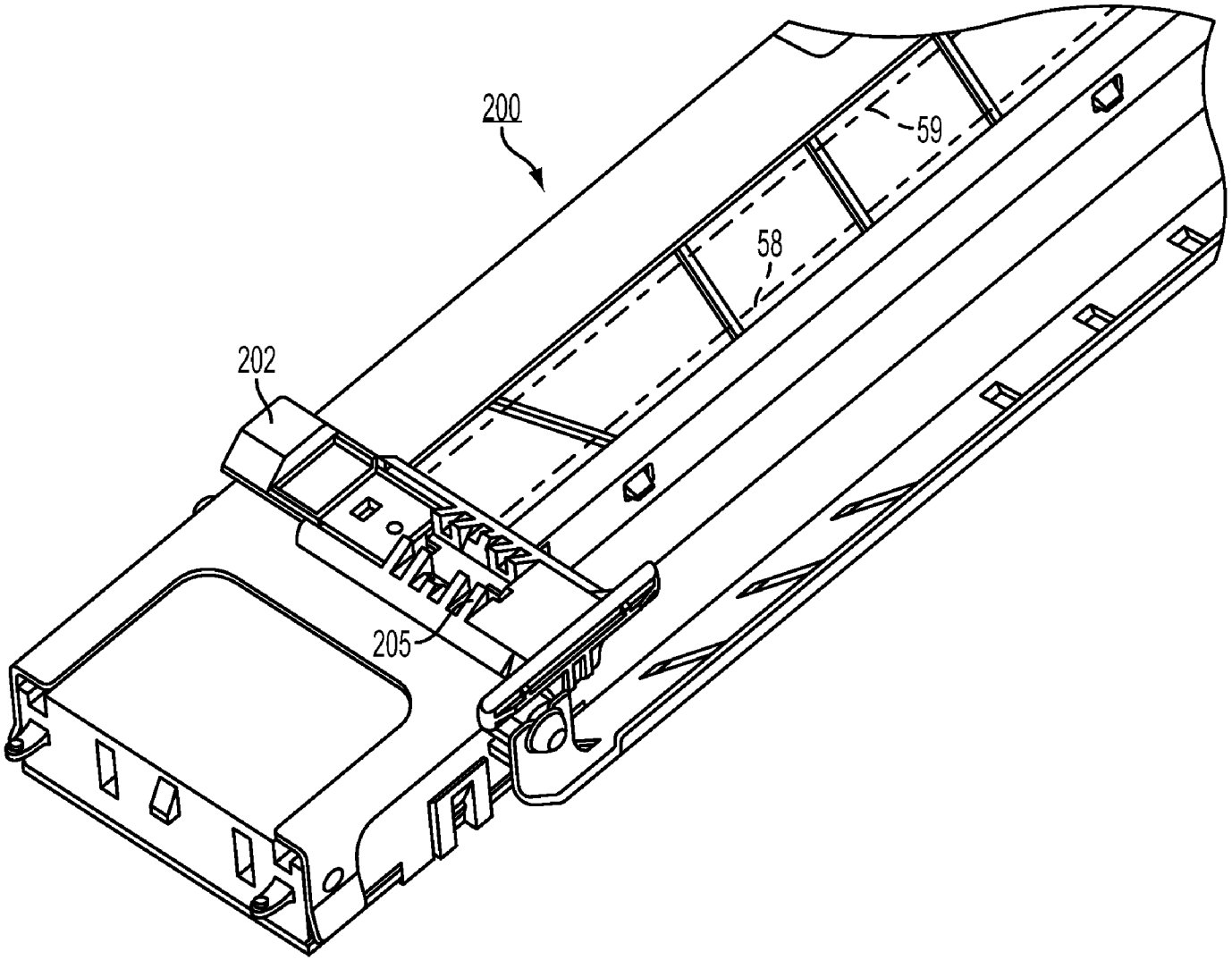
FIG. 10 is a partial bottom perspective view of the cleaning head showing inclined ramps leading into a receptacle thereof.

In FIGS. 7 and 8, one of bullet shaped locating pins 207 of engagement latch 206 is shown more clearly as it is supported for movement along shaft 204, and in FIG. 9, locating pin 207 of engagement latch 206 is shown seated within cleaner head 202 between inclined ramps 205. Now, movement of engagement latch 205 will also move cleaner head 202 along shaft 204. In FIG. 10, the receptacle area for seating of locating pin 207 between ramps 205 is shown in cleaning head 202.

In recapitulation, cleaning of corotron wires is accomplished by moving a wire cleaning head up and down the length of the corotron wires with a drive mechanism located within the short paper path. The drive mechanism includes a small DC motor connected to a two-start threaded drive shaft by means of a worm and wheel gear arrangement. Captive to the drive shaft is a threaded drive nut with a sprung engagement designed to mate with a profile on the base of the corotron cleaning head. When a customer installs a corotron into the short paper path, the cleaning head needs to be located into the drive/engagement latch. Unfortunately, the cleaning head can be in any position along the length of the corotron. To enable the drive latch to engage with the cleaning head, the drive latch is moved the length of the corotron. This motion pushes the cleaning head along until it reaches the end of its travel. The drive continues to move forcing the latch spring to compress as it is driven down an entry ramp. At the limit of the drive travel, the latch will reach engagement and will locate securely into the cleaner head. At predetermined times the cleaner is driven the length of the corotrons to facilitate a cleaning function. If the corotron needs to be replaced it can be simply lifted out of the short paper path as the drive mechanism will disengage as the corotron unit is lifted out.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An electrophotographic printing machine of the type including a customer replaceable unit, comprising:

a paper path assembly for transporting copy sheets within said printing machine for further processing, said paper path assembly including an engagement latch having a movable, bullet shaped locating pin adapted to mate with said wire cleaning head;

a housing for mounting components having a service life less than said printing machine, said components including at least one corotron wire;

a movable wire cleaning head including a cleaning material for cleaning said at least one corotron wire, said cleaning head including ramps as a portion thereof and wherein said locating pin is adapted for positioning within a receptacle of said wire cleaning head to facilitate driving said wire cleaning head the length of said at least one corotron wire;

a motor driven drive mechanism for driving said engagement latch along the length of said at least one corotron wire, and;

wherein actuation of said motor of said drive mechanism drives said protrusions down said ramps of said cleaning head in order to position said protrusions with said receptacle of said cleaning head.

2. A xerographic device including a cleaning head pick-up system for cleaning at least one corotron wire of a customer replaceable unit, comprising:

a wire cleaning head including a cleaning material for cleaning said at least one corotron wire and a downwardly extending inclined ramp as a part thereof; and a springable engagement latch that mates with said wire cleaning head and a support structure for supporting said springable engagement latch, said springable engagement latch including an integral locating pin projecting from an end thereof; and a drive mechanism drivingly connected to said springable engagement latch for driving said springable engagement latch into said downwardly extending inclined ramp of said wire cleaning head.

3. The xerographic device of claim 2, wherein said wire cleaning head is detachable from said engagement latch.

4. The xerographic device of claim 3, wherein said springable engagement latch is driven down said inclined ramp by said drive mechanism.

5. The xerographic device of claim 4, wherein said wire cleaning head includes a recessed receptacle in a center portion thereof.

6. The xerographic device of claim 5, wherein said locating pin is adapted to spring up into said recessed receptacle of said cleaning head after said springable engagement latch is driven down said downwardly extending inclined ramp.

7. The xerographic device of claim 6, wherein positioning of said locating pin within said recessed receptacle of said wire cleaning head facilitates driving said wire cleaning head the length of said at least one corotron wire.

8. The xerographic device of claim 2, wherein said wire cleaning head includes a pair of ramps as a portion thereof.

9. The xerographic device of claim 2, wherein said integral locating pin is self-seating.

10. A method for cleaning corotron wires of a printing machine of the type including a customer replaceable unit, comprising:

providing a paper path assembly for transporting copy sheets within said printing machine for further processing;

providing a housing for mounting components having a service life less than said printing machine, said components including at least one corotron wire;

providing a wire cleaning head including a cleaning material for cleaning said at least one corotron wire and a downwardly extending inclined ramp as a part thereof;

providing a springable engagement latch mechanism with an integral locating pin projecting from an end thereof;

providing said paper path assembly with a drive mechanism drivingly connected to said springable engagement latch mechanism;

driving said springable engagement latch mechanism into said inclined ramp of said wire cleaning head; and cleaning said at least one corotron wire by periodically actuating said drive mechanism and driving said wire cleaning head the length of said at least one corotron wire.

11. The method of claim 10, wherein said springable engagement latch is deflected down said inclined ramp.

12. The method of claim 11, wherein said wire cleaning head includes a recessed receptacle in a center portion thereof.

13. The method of claim 12, including springing said springable engagement latch mechanism up into said recessed receptacle portion of said wire cleaning head.

14. The method of claim 13, including springing said springable engagement latch mechanism up into said recessed receptacle portion of said wire cleaning head after said deflection down said inclined ramp.

15. The method of claim 14, wherein said springable engagement latch mechanism is sprung up into said recessed receptacle portion of said wire cleaning head.

16. The method of claim 14, wherein lifting said wire cleaning head from said springable engagement latch mechanism releases said cleaning head from said springable engagement latch mechanism.

17. The method of claim 10, including providing said wire cleaning head with at two inclined ramps.

18. The method of claim 17, including capturing said springable engagement latch mechanism between said two inclined ramps of said wire cleaning head.

19. The method of claim 18, wherein movement of said springable engagement latch mechanism moves said wire cleaning head.

20. The method of claim 18, including seating said locating pin between said two inclined ramps.

21. The method of claim 10, including providing said locating pin with a curved end portion.

* * * * *